US006079126A

United States Patent [19]

Olszewski

[11] Patent Number: 6,079,126

[45] Date of Patent: Jun. 27, 2000

[54] SHOE CONSTRUCTION

[76] Inventor: Jan S. Olszewski, 3859 38th Ave. South, Minneapolis, Minn. 55406

[21] Appl. No.: 09/141,492

[22] Filed: Aug. 27, 1998

Related U.S. Application Data

[63] Continuation-in-part of application No. 08/920,358, Aug. 29, 1997, abandoned.

[51] Int. Cl.[7] ..... A43B 13/14; A43B 1/10

[52] U.S. Cl. ..... 36/31; 36/102; 36/103

[58] Field of Search ..... 36/31, 33, 25 R, 36/34 R, 102, 103, 114

[56] References Cited

U.S. PATENT DOCUMENTS

| | | | |
|---|---|---|---|
| 2,369,531 | 2/1945 | Caltabiano | 36/31 |
| 2,466,580 | 4/1949 | Dalbey | 36/31 |
| 2,599,970 | 6/1952 | Barrons | 36/31 |
| 3,952,429 | 4/1976 | Thomas | 36/31 |
| 4,240,214 | 12/1980 | Sigle et al. | 36/31 |
| 4,309,832 | 1/1982 | Hunt | 36/31 |
| 4,314,413 | 2/1982 | Dassler | 36/25 R |
| 4,562,652 | 1/1986 | Hensler | 36/102 |
| 4,615,126 | 10/1986 | Mathews | 36/31 |
| 4,924,606 | 5/1990 | Montgomery et al. | 36/31 |
| 5,572,806 | 11/1996 | Osawa | 36/31 |

FOREIGN PATENT DOCUMENTS

| | | | |
|---|---|---|---|
| 1674784 | 9/1991 | Switzerland | 36/102 |

*Primary Examiner*—M. D. Patterson

*Attorney, Agent, or Firm*—Nawrocki, Rooney & Sivertson, P.A.

[57] ABSTRACT

A shoe construction is provided which conforms to the natural design and movement of a human foot. The shoe includes a bottom and an upper. The bottom is defined by a heel, an arch portion, a hinge portion and a forward portion. The upper is attached to a top surface of the bottom and includes a thinned section overlying the hinge portion. During use, the hinge portion and thinned section act in concert to facilitate a natural walking and/or running motion. In this regard, the hinge portion encourages pivoting of the foot at the ball. Similarly, the thinned section is configured to buckle during a pivoting motion of the foot. Thus, the thinned section provides minimal resistance as the foot maneuvers through a running motion.

8 Claims, 5 Drawing Sheets

SHOE CONSTRUCTION

Cross-Reference to Related Applications

The present application is a continuation-in-part of Application Ser. No. 08/920,358, filed Aug. 29, 1997, entitled "Shoe Construction", now abandoned.

Background of the Invention

The present invention relates to a shoe construction. More particularly, it relates to a shoe configured to conform to, and promote the natural design and movement of, a human foot.

While the invention relates to shoes of all types, discussion hereinafter will focus upon an athletic shoe embodiment. Over the past several decades, the popularity of "high performance" athletic shoes has increased dramatically. In an attempt to capitalize on this demand, athletic shoe manufacturers have devised various design and marketing techniques. For example, athletic shoe manufacturers commonly produce varying styles of shoes for different sports. These include shoes for running, basketball, cross training, wrestling, to name but a few. Each style of shoe is then promoted as having certain attributes designed to enhance an athlete's performance in a particular sport. Additional design and/or marketing techniques include adding brightly-colored materials to the shoe's exterior, supplying extra padding at various locations on or in the shoe, increasing sole thickness, providing inflatable bladders within the shoe, etc.

While each of the above techniques has been met with at least some degree of success, a basic requirement for an athletic shoe may have been overlooked. Namely, for most sport activities, the shoe should conform as close as possible to the natural design and movement of the wearer's foot. For example, the sport of running demands that the athlete's foot be repeatedly lifted and touched to the ground. As the foot touches the ground, a force is imparted. This force, in turn, is transmitted from the ground to the foot, providing energy for subsequent raising of the foot. The running motion further entails a pivoting or flexure motion of the foot at the ball and forward portion. To provide optimal performance when running, an athletic shoe should ultimately be designed so as to minimize energy loss and any interference with the natural pivoting motion.

Unfortunately, many athletic shoe designs fail to account for the natural walking and/or running movement. For example, the bottom or sole portion of the shoe is oftentimes formed of a very thick rubber material. While the rubber material may protect the foot from sharp objects and can be stylized to enhance visual appearance of the shoe, it in fact decreases running efficiency. More specifically, a thick sole acts to absorb energy created by the runner, resulting in a less energy efficient running motion.

Additionally, while the rubber sole may include tread to improve traction, this tread oftentimes impedes the natural motion of the foot. Once again, a natural running motion entails pivoting or flexure of the foot at the ball. Regardless of the amount of traction provided, if the shoe sole is even relatively stiff, it will prevent this natural pivoting action from occurring. This negative affect may be further amplified by the shoe's upper portion. A standard shoe design generally includes a single-piece upper extending from the sole and encompassing the foot. The upper is normally made of relatively stiff leather that resists bending. This resistance to bending directly counteracts the normal flexure at the top of the foot. Thus, the standard shoe design, including a thick sole and relatively rigid upper, impedes natural pivoting and reduces energy efficiency.

An additional problem associated with a standard shoe design is failure to account for an individual wearer's natural foot inclination. It is widely acknowledged that the human foot varies from person to person in both size and instep inclination. Thus, a large number of people have feet which incline either inwardly or outwardly about a central longitudinal axis of the foot. That is to say, many people are either pigeon-toed or slew-footed. The standard shoe design does not take into account this naturally-occurring variation. Instead, the heel portion of a standard shoe design is configured to support the wearer's heel along a relatively horizontal plane. Thus, an athlete who is pigeon-toed or slew-footed will have their foot forced into an unnatural position by the shoe. Obviously, the athlete's natural running motion is negatively impacted, thereby decreasing efficiency.

While styles and designs of athletic shoes continue to evolve, certain basic requirements for efficient running and/or walking motions have not been met. Therefore, a substantial need exists for a shoe construction designed to conform as close as possible to natural foot shape and motion.

SUMMARY OF THE INVENTION

The present invention provides a shoe construction designed to facilitate natural movement of a wearer's foot. The shoe construction of the present invention is comprised of a bottom and an upper. The bottom includes a heel, an arch portion, a hinge portion and a forward portion. The hinge portion is disposed between the arch portion and the forward portion, and is configured to facilitate pivoting of the arch portion relative to the forward portion. The upper extends from a top surface of the bottom and is configured to encompass a user's foot. In this regard, the upper includes a thinned area extending from the hinge portion of the bottom. The thinned area is configured to easily buckle upon pivoting of the hinge portion.

During use, the shoe construction of the present invention allows for natural motion of the foot during walking and/or running such that the motion is more energy efficient. In this regard, the hinge portion of the bottom allows a user's foot to naturally pivot about the foot's ball while the thinned area buckles. Thus, the hinge portion in combination with the thinned area are configured so as to minimize any unnecessary restrictions during walking and/or running.

An alternative embodiment of the present invention includes a depression along the top surface of the bottom. The depression is configured to underlie a forward portion of a user's foot and is preferably sized to accommodate a ball of the foot. With this alternative embodiment, the shoe construction closely conforms to a natural shape of a user's foot. In another alternative embodiment, the heel of the bottom is a thick, substantially rigid body which is machinable. In this regard, the heel is machined to match an axis along which a user of the shoe deploys his or her foot when walking. Thus, the heel is uniquely designed to accommodate a pigeon-toed or slew-footed user. In yet another alternative embodiment, the heel has a ground contact point which extends rearward of the human foot to facilitate pivoting of the shoe as the user of the shoe walks.

DETAILED DESCRIPTION OF THE INVENTION

Figure 1:
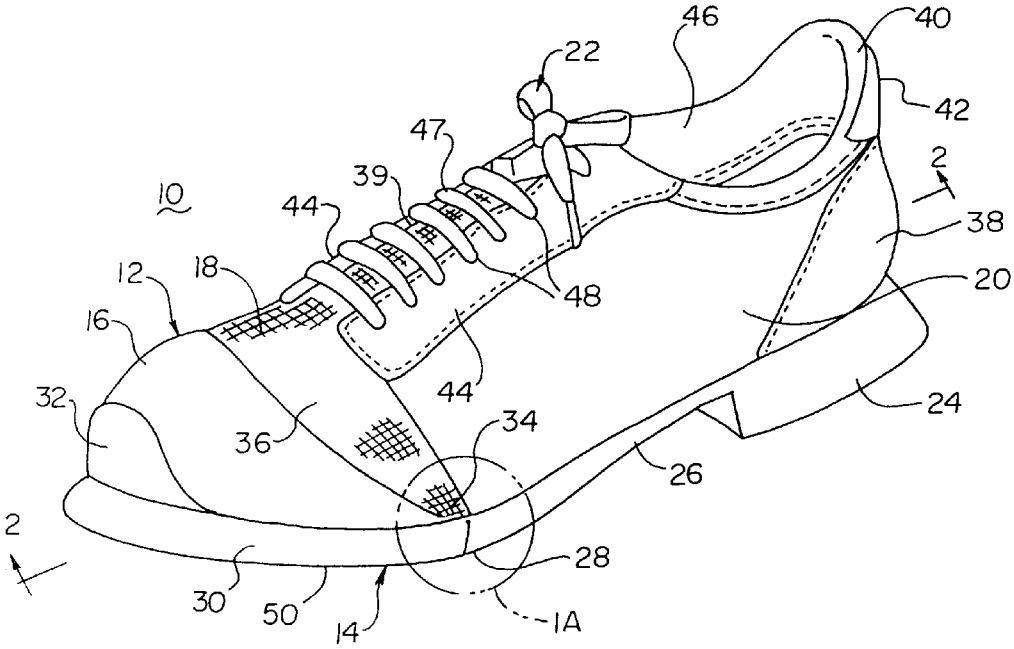
FIG. 1 is a perspective view of a shoe construction in accordance with the present invention.

A preferred embodiment of a shoe construction 10 is shown in FIG. 1. The shoe 10 is comprised of an upper 12, an insole (not shown) and a bottom 14. The upper 12 includes a toe box 16, a thinned section 18, a quarter 20 and a closure means 22. The bottom 14 includes a heel 24, an arch portion or shank portion 26, a hinge portion 28 and a forward portion 30. The upper 12 is attached to and extends upwardly from a top surface (not shown) of the bottom 14 and is preferably configured to encompass a user's foot (not shown). The insole overlies the top surface of the bottom 14 to provide a soft surface for a user's foot.

In a preferred embodiment, the toe box 16, the thinned section 18, the quarter 20 and the closure means 22 are manufactured separately.

The toe box 16 is configured to encompass a user's toe (not shown) and preferably includes a protective bumper 32 at a leading end thereof. The toe box 16 is made of a relatively rigid leather material so as to maintain the shape shown in FIG. 1. Alternatively, other materials, such as rubber, may also be useful. The protective bumper 32 serves to protect a user's toe and is preferably made of a rubber material. The toe box 16 is preferably configured to be attached to the forward portion 30 of the bottom 14 by stitching (not shown) and extends upwardly therefrom.

The thinned section 18 is defined by attachment ends 34 and a top side 36. Notably, FIG. 1 shows only one of the attachment ends 34. It should be understood, however, that the thinned section 18 includes a second attachment end 34 at an opposite side of the shoe 10 not otherwise shown in FIG. 1. Alternatively, the thinned section 18 can comprise two portions, each having an attachment end 34 mounted to the bottom 14 at opposite sides. With this construction, the two portions would be connected at the top side 36. The attachment ends 34 of the thinned section 18 are configured to overlie, and cooperate with, the hinge portion 28 of the bottom 14. Further, the thinned section 18 will preferably increase in width from the attachment ends 34 to the top side 36. Thus, the attachment ends 34 have a longitudinal width which is less than that of the top side 36.

As shown in FIG. 1, the top side 36 of the thinned section 18 forms a tongue 39 proximate the closure means 22. Alternatively, the tongue 39 can be manufactured separately and secured to the top side 36 of the thinned section 18.

The thinned section 18 is preferably made of a lightweight, flexible material. In a preferred embodiment, the thinned section 18 has a strong tensile strength. Due to the flexible nature of the thinned section 18, the thinned section 18 provides minimal restrictions upon a normal running/walking motion. As described in greater detail below, as the quarter 20 is pivoted toward the toe box 16 during a natural motion of the foot (not shown), the thinned section 18 is configured to easily buckles so as to not restrict movement.

The quarter 20 is preferably a single strip of material extending along opposite sides of the arch portion 26 and about the heel 24 of the bottom 14. In a preferred embodiment, the quarter 20 can further include a heel reinforcement 38, a binding 40, a counter 42 and a pair of flaps 44. The heel reinforcement 38 is preferably a relatively rigid piece of material attached by stitching to a rear portion of the quarter 20 for supporting a user's heel (not shown). The binding 40 is sewn along an upper portion of the quarter 20 and defines a foot-receiving opening 46. In this regard, the binding 40 is preferably a strip of reinforced material configured to support a user's upper foot or ankle (not shown). The counter 42 is disposed along a rearward portion of the binding 40 to assist in directing a user's foot into the foot-receiving opening 46. Finally, the pair of flaps 44 are disposed along opposite sides of the quarter 20 to reinforce the closure means 22.

In a preferred embodiment, the quarter 20 is made of a leather material. However, other materials, such as nylon or rubber, may also be useful. The quarter 20 is preferably configured to be attached to the bottom by stitching (not shown). Alternatively, other forms of attachment, such as an adhesive, may be used.

The closure means 22 is preferably comprised of a shoelace 47 and a plurality of eyelets 48. The eyelets 48 are positioned along the pair of flaps 44 of the quarter 20 and are sized to receive and maintain the shoelace 47. The shoelace 47 and the eyelets 48 function in a manner highly similar to a standard shoe design. Thus, the shoelace 47 is tightened within the eyelets 48 to secure a user's foot (not shown) within the shoe 10. Alternatively, other closure means, such as a buckle or VELCRO®, may also be useful. Even further, the closure means 22 can be eliminated such that the quarter 20 is a singular body extending from opposite sides of the bottom 14.

Upon final assembly, each of the toe box 16, the thinned section 18 and the quarter 20 are attached to the bottom 14 as shown in FIG. 1. In this regard, the toe box 16 preferably overlies the forward portion 30; the thinned section 18 overlies the hinge portion 28; and the quarter 20 overlies the arch portion 26 and the heel 24. Further, the toe box 16 is preferably secured to a portion of the thinned section 18 by stitching. Similarly, the thinned section 18 is secured to the quarter 20 by stitching. The tongue 39 is preferably not secured to the quarter 20. Notably, the thinned section 18 has a thickness less than that of the toe box 16 or the quarter 20.

As previously described, the bottom 14 is comprised of the heel 24, the arch portion 26, the hinge portion 28 and a forward portion 30. In a preferred embodiment, the heel 24, the arch portion 26, the hinge portion 28 and the forward portion 30 are integrally formed as a singular body. Alternatively, the heel 24 may be manufactured separately and attached to the bottom 14. With this configuration, the bottom 14 is defined by an outsole, including the arch portion 26, the hinge portion 28 and the forward portion 30, and a separate heel extension to which the heel 24 is attached. Regardless of exact construction, the various components of the bottom 14 are arranged such that the hinge portion 28 is disposed between the arch portion 26 and the forward portion 30.

The heel 24 is configured to support a user's heel (not shown). In this regard, the heel 24 is a relatively thick body, comprised of a lightweight, cushioning material. As described in greater detail below, the heel 14 is preferably configured to accommodate different walking/running styles.

The arch portion 26 extends from the heel 24 and is preferably configured to be coextensive with a user's arch portion (not shown). Thus, the arch portion 26 is made of a lightweight material. Further, the arch portion 26 generally slopes from the heel 24 to the hinge portion 28, similar to the contour of a human foot.

The forward portion 30 is configured to support a forward end or toes of a user's foot (not shown). The forward portion 30 is preferably made of a lightweight material, such as rubber, and may include treads (not shown) on a lower surface 50. Regardless of exact configuration, the lower surface 50 of the forward portion 30 is designed to contact the ground during use.

Figure 1A:
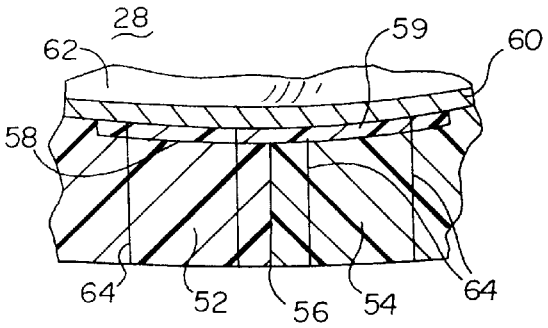
FIG. 1A is an enlarged, fragmentary cross-sectional view of a hinge portion of the shoe construction in a relaxed position in accordance with the present invention.

The hinge portion 28 is disposed between the arch portion 26 and the forward portion 30 and is preferably configured to facilitate pivoting of the arch portion 26 relative to the forward portion 30. In one preferred embodiment, the hinge portion 28 includes a forward wall 52, a rearward wall 54, an elongated slit 56, a transverse slot 58 and a material strip 59 as shown in FIG. 1A. Notably, FIG. 1A also shows the insole 60 of the shoe 10 and a user's foot 62.

The elongated slit 56 extends across the bottom 14 in a direction generally perpendicular to a longitudinal axis of the shoe 10 and is defined by the forward wall 52 and the rearward wall 54. The transverse slot 58 is similarly defined by the forward wall 52 and the rearward wall 54. However, the transverse slot 58 is perpendicular to the orientation of the elongated slit 56 and is sized to maintain the material strip 59.

The material strip 59 is a highly flexible body, such as nylon, sized to extend across a width of the shoe 10. As described in greater detail below, the material strip 59 enables flexure of the user's foot 62, thereby acting as a living hinge.

In a preferred embodiment, the hinge portion 28 is constructed by placing the material strip 59 against the insole 60, as shown in FIG. 1A. The forward wall 52 and the rearward wall 54 are fastened to the material strip 59 and the insole 60 by stitching 64. Notably, the transverse slot 58 is preferably preformed in the forward wall 52 and the rearward wall 54 so that the material strip 59 fits snugly between the insole 60 and the forward wall 52 and the rearward wall 54. Alternatively, the material strip 59 can be encompassed by the forward wall 52 and the rearward wall 54 during a molding process. The elongated slit 56 is formed at an abutment plane between the forward wall 52 and the rearward wall 54.

Figure 1B:
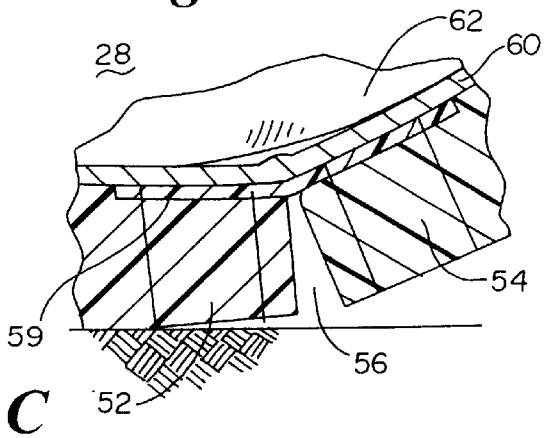
FIG. 1B is an enlarged, fragmentary cross-sectional view of the hinge portion shown in FIG. 1A in a flexed position in accordance with the present invention.

With the above-described construction, the hinge portion 28 enables flexure of the user's foot 62 from a relaxed position (FIG. 1A) to a flexed position (FIG. 1B). As shown in FIG. 1B, as the foot 62 flexes, such as during a walking or running motion, the hinge portion 28 pivots, with the rearward wall 54 pivoting away from the forward wall 52 at the material strip 59. Due to the flexible nature of the material strip 59, the material strip 59 presents minimal resistance to this desired action. Thus, the material strip 59 extends along its width, while the elongated slit 56 expands. Notably, in a preferred embodiment, the insole 60 has a flexibility characteristic whereby it easily buckles at the pivot point of the hinge portion 28.

Preferably the hinge portion 28 is configured such that both the forward wall 52 and the rearward wall 54 have a thickness sufficient to contact the ground in the relaxed state (FIG. 1A). In other words, the hinge portion 28 supports a user relative to the ground on either side of the elongated slit 56 in the relaxed state. Alternatively, the forward wall 52 can be defined as a portion of the forward portion 30; and the rearward wall 54 as a portion of the arch portion 26. With this configuration, the forward portion 30 and the arch portion 26 define the elongated slit 56 and support a wearer on opposite sides of the elongated slit 56.

Figure 1C:
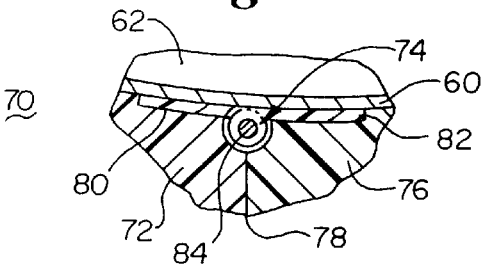
FIG. 1C is an enlarged, fragmentary cross-sectional view of a hinge portion of an alternative embodiment of the shoe construction in accordance with the prevent invention.

An alternative embodiment of a hinge portion 70 is provided in FIG. 1C. The hinge portion 70 includes a forward wall 72, a hinge mechanism 74 and a rearward wall 76. The forward wall 72 and the rearward wall 76 define a countersink 77 and an elongated slit 78. The hinge mechanism 74 is disposed within the countersink 77 and includes a first plate 80, a second plate 82 and a pin 84.

The first plate 80 extends within the forward wall 72 and is configured to underlie the insole 60. Similarly, the second plate 82 extends into the rearward wall 76 and underlies the insole 60. The first plate 80 is connected to the second plate 82 by the pin 84 in a hinging fashion. During a pivoting movement of a user's foot 62, the hinge portion 70 facilitates the requisite pivoting action of the foot 62 by the second plate 82 pivoting relative to the first plate 80 at the pin 84.

Figure 2:
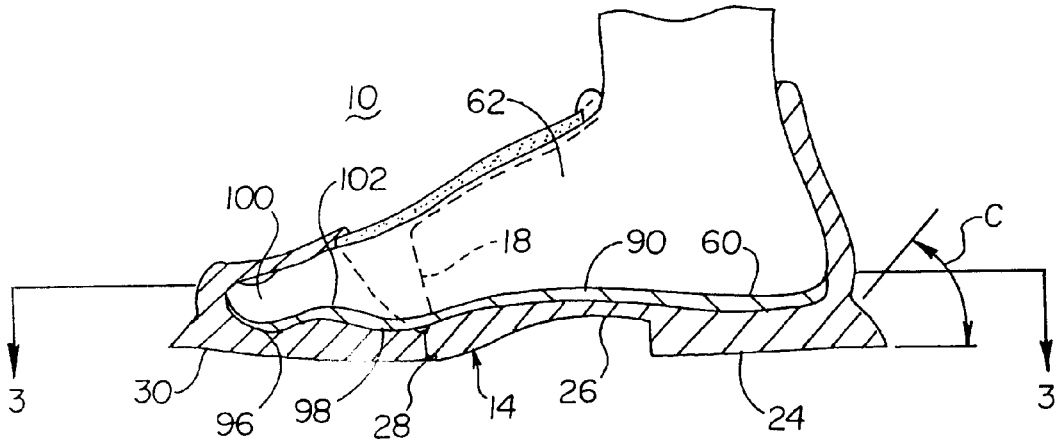
FIG. 2 is a sectional view of the shoe construction of the present invention along the line 2—2 of FIG. 1.

As shown in FIG. 2, the bottom 14 further includes a top surface 90 defined by the heel 24, the arch portion 26, the hinge portion 28 and the forward portion 30. As a point of reference, FIG. 2 also shows the insole 60 overlying the top surface 90 of the bottom 14. The insole 60 is made of cloth or other soft material and acts as a buffer between the top surface 90 of the bottom 14 and the human foot 62.

The top surface 90 of the bottom 14 is preferably configured to conform to a natural contour of the foot 62. In this regard, the top surface 90 preferably includes a toe depression 96 and a ball depression 98. The toe depression 96 and the ball depression 98 are preferably formed along the forward portion 30. The insole 60 is preferably flexible so as to nest within the toe depression 96 and the ball depression 98, thereby matching the contour of the top surface 90. The toe depression 96 is preferably sized to receive toes 100 of the foot 62. Similarly, the ball depression 98 is preferably configured to receive a ball 102 of the foot 62.

During use, the foot 62 is placed within the shoe 10 and the closure means 22 (FIG. 1) tightened. As the foot 62 maneuvers through a normal walking and/or running motion, the foot 62 pivots at the ball 102. The shoe 10 is designed to accommodate this natural motion. In particular, as the foot 62 flexes, the bottom 14 easily pivots at the hinge portion 28 as previously described. In other words, the bottom 14 is designed to present minimal resistance to, and to even facilitate, the natural pivoting motion such that the arch portion 26 and heel 24 pivot relative to the forward portion 30. Additionally, the thinned section 18 (shown with dashed lines as wedge-shaped in FIG. 2) buckles as the foot 62 flexes. Thus, the thinned section 18 of the upper 12 is configured to present minimal resistance to the natural walking/running motion of the foot 62. Finally, the toe depression 96 and the ball depression 98 serve to enable the transmission of a horizontal force component between the toes 100 and the ball 102 of the foot and shoe 10.

Figure 3:
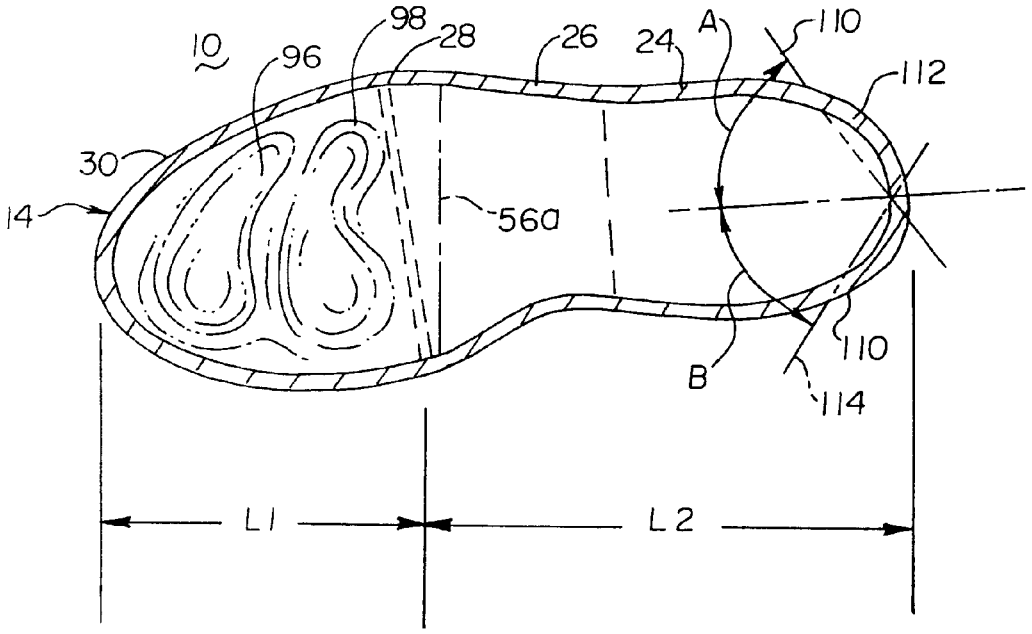
FIG. 3 is a cross-sectional view of the shoe construction of the present invention taken along the line 3—3 of FIG. 2.

In a preferred embodiment, the elongated slit 56 extends across the bottom 14 in a direction generally perpendicular to a longitudinal axis of the shoe 10 as shown in FIG. 3. However, orientation of the elongated slit 56 can be altered such that the elongated strip 56 extends in other directions, as shown, for example, by the dashed line 56a in FIG. 3.

As previously described, the heel 24 is preferably configured to accommodate different styles of running or walking. It is well accepted that the human foot varies in shape and angle of deployment relative to an axis of intended movement. Thus, whereas some persons have a relatively "straight" foot, others are either pigeon-toed or slew-footed. The heel 24 can be configured to be machined to accommodate these variations in foot orientation. As shown in FIG. 3, the shoe 10 includes the bottom 14 having the heel 24, the arch portion 26, the hinge portion 28 and the forward portion 30. Once again, the forward portion 30 preferably includes the toe depression 96 and the ball depression 98.

The heel 24 includes an approximately three-quarter inch high vertical wall. The wall is preferably stiff, but can be machined to define a generally vertical planar surface depending upon a particular user's foot. Thus, if the user of the shoe 10 is slew-footed, a bevel or facet (shown as the line 110 in FIG. 3) on an outside 112 of the heel 24 can be created. Depending upon the severity of foot inclination, the bevel 110 can be varied by angle A relative to a longitudinal axis of the shoe 10. Conversely, if the user is pigeon-toed, a bevel (shown by the line 114 in FIG. 3) on an inside 116 of the heel 24 can be imparted. Depending upon the severity of foot inclination, the bevel 114 can be varied by angle 2 relative to the longitudinal axis of the shoe 10. Notably, the bevel 110 or 114 need not be imparted perpendicular to the generally flat planar surface of the shoe 10. Instead, the bevel 110 or 114 can be varied by an angle C (FIG. 2) relative to the flat bottom surface of the heel 24. With the machinable heel 24 of the present invention, the user's foot inclination is first evaluated and the bevel 110 or 114 imparted where appropriate. By providing the bevel 110 or 114, the shoe 10 will be constructed so as to recognize and facilitate the natural foot inclination and therefore movement of the user.

An additional feature of the shoe 10 of the present invention is an improved size designator characteristic. Standard shoe sizes are designated by a single number, normally representative of shoes length. While some allowance for foot width may also be included, only a single number is normally provided. The shoe 10 of the present invention, however, provides for a shoe size system including two or more numbers. With reference to FIG. 3, the shoe 10 of the present invention can be "sized" in reference to a length L1 of the forward portion 30, and to a length L2 of the arch portion 26 and the heel 24. An additional sizing reference is the angle required for the bevel 110 or the bevel 114. Thus, size of the shoe 10 of the present invention can be described with reference to the forward portion 30 length L1, the arch 26 and the heel 24 L2, and the bevel angle.

Figure 4:
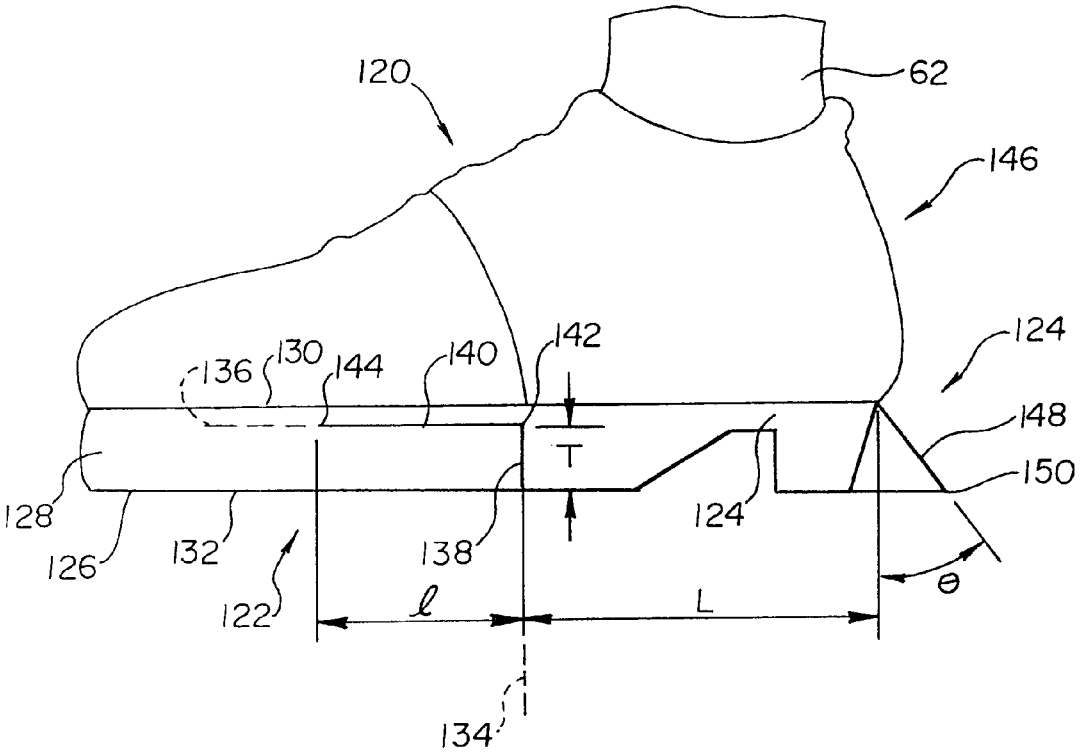
FIG. 4 is a side elevational view of the shoe showing a hinge portion in a relaxed position and a heel portion, in accordance with alternative embodiments of the present invention.

FIG. 4 is a side elevational view of the shoe showing a hinge portion in a relaxed position and a heel portion, in accordance with alternative embodiments of the present invention. The shoe is shown generally at 120. The hinge portion 122 is disposed between the arch portion 124 and the forward portion 126, and is configured to facilitate pivoting of the arch portion 124 relative to the forward portion 126. The sole 128 has a thickness defined by top surface 130 and a bottom surface 132. The hinge portion 122 is bifurcated along a first plane 134 and a second plane 136, wherein the first plane 124 intersects the top surface 130 and the bottom surface 132. The hinge portion 122 has a first slit 138 which is unobstructed at the bottom surface 132. The second plane 136 is substantially perpendicular to the first plane 134 and has a second slit 140 which extends from the first slit 134 at a rearward end 142 to a forward end 144 in a direction of the forward portion 126. The distance between the rearward end 142 and the forward end 144 of the second slit 140 is preferably five times or more greater than a distance between the rearward end 142 of the second slit 140 and the bottom surface 132 of the sole 128 to reduce mechanical stress of hinge portion 122 between second slit 140 and top surface 130. A pivot axis parallel to the second plane facilitates pivoting of the arch portion 124 relative to the forward portion 126. Hinge portion 122 is further configured to support a user relative to the ground on either side of first slit 138 in the relaxed state. An upper 146 is shown which is similar to upper 12 shown and described in reference to FIG. 1.

The heel portion 124 is a thick, substantially rigid block. The heel portion 124 may include a rear edge 148 which is machined to define an angle theta with respect to a line perpendicular to the bottom surface 132. The angle theta moves the contact point 150 of heel portion 124 rearward to increase the leverage and thus ease in which the foot may bring bottom surface 132 in ground contact while walking. The mechanical moment may be described by the dimension "L" with respect to the first plane 134.

Figure 5:
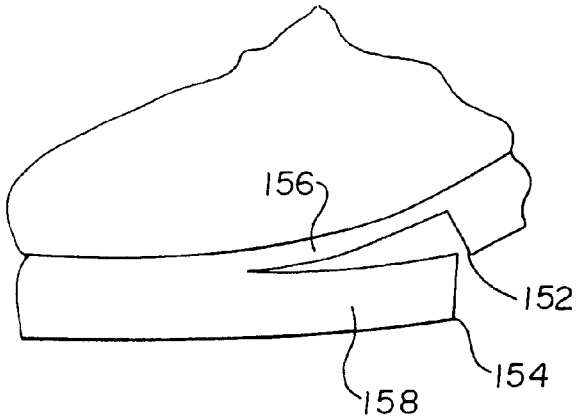
FIG. 5 is a fragmentary cross-sectional view of the hinge portion shown in FIG. 4 in a flexed position in accordance with an alternative embodiment of the present invention.

With the above-described construction, the hinge portion 122 enables flexure of the user's foot 62 from a relaxed position (FIG. 4) to a flexed position (FIG. 5). As shown in FIG. 5, as the foot 62 flexes, such as during a walking or running motion, the hinge portion 122 pivots, with the rearward wall 152 pivoting up and away from the forward wall 154 along second slit 140. Due to the flexible nature of the material within upper portion 156, relative to lower portion 158, minimal resistance is presented to this desired action. The flexibility characteristic of upper portion 156 allows it to flex evenly along the length "l" of second slit 140 which reduces material stress and wear of sole 128 along upper portion 156.

Figure 6:
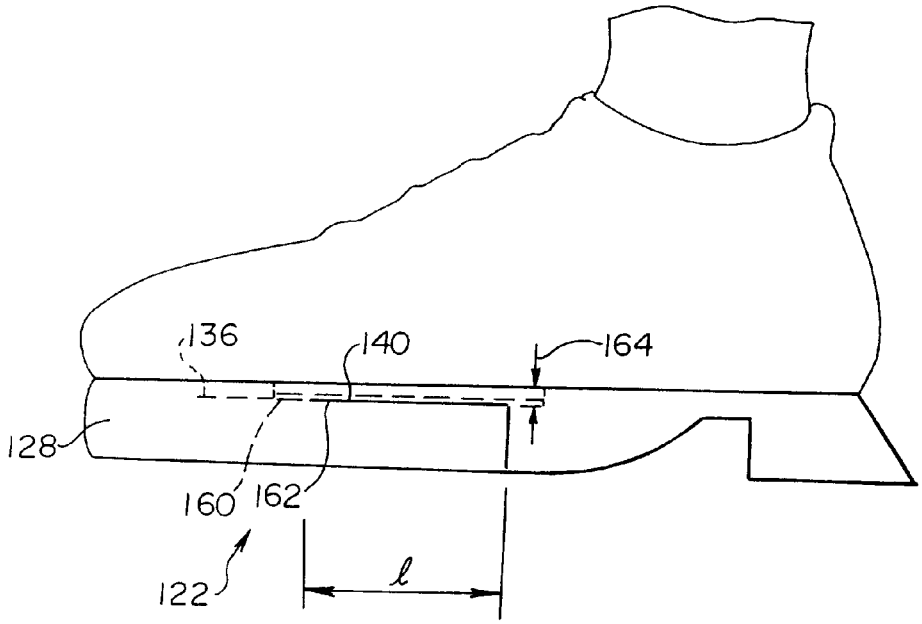
FIG. 6 is a sectional view of the shoe construction taken along a longitudinal axis of the shoe of FIG. 4 in accordance with an alternative embodiment of the present invention.

FIG. 6 is a sectional view of the shoe construction taken along a longitudinal axis of the shoe of FIG. 4 in accordance with an alternative embodiment of the present invention. The shoe includes a flexible metal sheet 160 attached to the sole at the hinge portion 122. The metal sheet is preferable constructed of spring steel to provide a resilient resistance to the sole 128 as the sole is flexed from the relaxed to the flexed position. The metal sheet 160 lies within the second plane 136 and has a minimum area which is coextensive with the second slit 140. In this respect the metal sheet functions as either a portion or all of the upper portion 156 (depending on the thickness 164), and thus defines an upper surface 162 of the second slit 140. The metal sheet 160 further has a thickness shown at 164 wherein the resistance of the metal sheet 160 to being flexed as the sole 128 is flexed from the relaxed to the flexed position is proportional to the thickness of the metal sheet 160. The metal sheet 160 may be attached to sole 128 at one or more locations by one or more screws (not shown), or by other means such as bonding.

Figure 7:
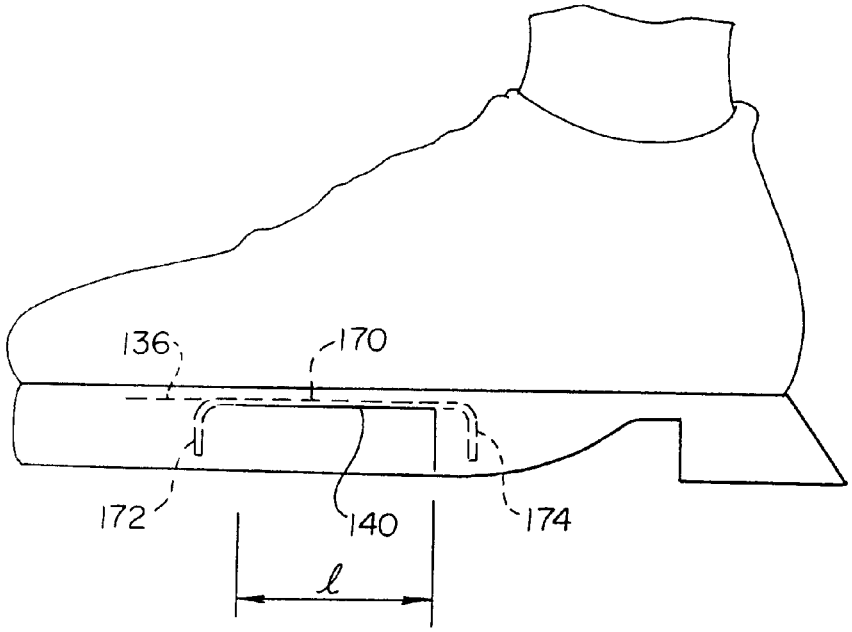
FIG. 7 is a sectional view of the shoe construction taken along a longitudinal axis of the shoe of FIG. 4 in accordance with an alternative embodiment of the present invention.

FIG. 7 is a sectional view of the shoe construction taken along a longitudinal axis of the shoe of FIG. 4 in accordance with an alternative embodiment of the present invention. The metal sheet 160 has a shape such that a center portion 170 lies within the second plane 136, while a forward portion 172 and a rearward portion 174 are downwardly directed into the sole towards the bottom surface 132. This allows the forward portion 172 and the rearward portion 174 to be molded within the sole 128, while the center portion 170 is maintained within the second plane 136. The center portion 170 has a minimum area which is coextensive with the second slit 140.

Figure 8:
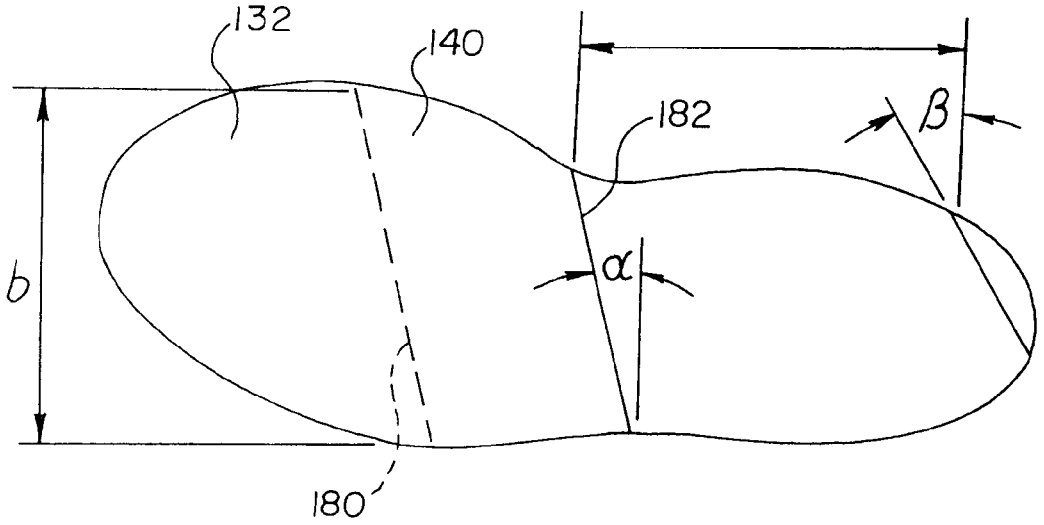
FIG. 8 is a bottom plan view of the shoe construction of the present invention.

FIG. 8 is a bottom plan view of the shoe construction of the present invention. FIG. 8 shows the metal sheet 140 has a width b which extends the width of the sole 128. A forward edge 180 of the metal sheet 140 is shown to be parallel to a rearward edge 182 of the metal sheet 140, where the forward edge 180 and the rearward edge 182 define an angle alpha relative to a line perpendicular to the longitudinal axis of the bottom surface 132 of the shoe. It is understood that the angle alpha may be measured with respect to the rearward edge 182 only, as in other embodiments the forward edge 180 may not be parallel to the rearward edge 182. The angle alpha may preferably be zero degrees. But as described earlier with respect to FIG. 3, if the user of the shoe is either slew-footed or pigeon-toed, the angle alpha can be adjusted so that rearward edge 182 is parallel to bevel 110 or bevel 114. Thus, depending upon the severity of foot inclination, the angles alpha and beta can be constructed to provide the maximum resilient resistance and strength to the sole 128 and facilitate the natural foot inclination and movement of the user.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. A shoe, comprising:

a bottom including a heel and a sole having an arch portion, a hinge portion and a forward portion, the sole having a thickness defined by top and bottom surfaces, the hinge portion of the sole being disposed between the arch portion and the forward portion, the hinge portion being bifurcated along a first plane and a second plane, the first plane intersecting the top and bottom surfaces and having a first slit defined which is unobstructed at the bottom surface, the second plane being substantially perpendicular to the first plane and having a second slit which extends from the first slit at a rearward end to a forward end in a direction of the forward portion, a pivot axis parallel to the second plane facilitating pivoting of the arch portion relative to the forward portion, upper and lower portions of said hinge portion defined by said second slit being separable as the arch portion pivots relative to the forward portion; and an upper extending from the top surface of the bottom for encompassing a foot, the upper including a thinned, pliable section extending from the hinge portion and configured to buckle upon pivoting at the hinge portion.

2. The shoe of claim 1, wherein the first slit extends substantially perpendicular to a longitudinal axis of the bottom.

3. The shoe of claim 1 wherein the second slit is substantially parallel to the top surface.

4. The shoe of claim 1 wherein a distance between the rearward end and the forward end of the second slit is five times or more greater than a distance between the rearward end of the second slit and the bottom surface of the sole.

5. The shoe of claim 1, wherein the upper includes a quarter and a toe box separated by the thinned, pliable section, the thinned, pliable section having a longitudinal dimension less than that of the quarter and the toe box.

6. The shoe of claim 1 further comprising an insole overlying the top surface of the bottom, the insole conforming to the top surface.

7. The shoe of claim 1, wherein the heel is a thick, substantially rigid block having a ground contact point which is extended rearward of the foot to facilitate a pivoting of the forward portion relative to the heel as a wearer of the shoe walks.

8. The shoe of claim 1, wherein a segment of the top surface overlying the forward portion of the bottom includes a depression sized to accommodate a ball of the user's foot.

* * * * *